US009861158B2

(12) United States Patent
Cross

(10) Patent No.: US 9,861,158 B2
(45) Date of Patent: Jan. 9, 2018

(54) AUXETIC STRUCTURES AND FOOTWEAR WITH SOLES HAVING AUXETIC STRUCTURES

(71) Applicant: NIKE, Inc., Beaverton, OR (US)

(72) Inventor: Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/643,274

(22) Filed: Mar. 10, 2015

(65) Prior Publication Data

US 2016/0262491 A1 Sep. 15, 2016

(51) Int. Cl.
*A43B 13/18* (2006.01)
*A43B 13/14* (2006.01)

(52) U.S. Cl.
CPC ..... *A43B 13/181* (2013.01); *A43B 13/14* (2013.01); *A43B 13/187* (2013.01)

(58) Field of Classification Search
CPC ... A43B 13/181; A43B 13/141; A43B 13/187; A43B 1/0009
See application file for complete search history.

(56) References Cited

U.S. PATENT DOCUMENTS 7,310,894 B1 * 12/2007 Schwarzman ..... A43B 13/223 36/3 A
8,322,050 B2 * 12/2012 Lubart ..... A43B 13/223 36/59 C
8,652,602 B1 * 2/2014 Dolla ..... B29C 44/357 428/36.1
2005/0142331 A1 * 6/2005 Anderson ..... B31F 1/07 428/152
2005/0252037 A1 * 11/2005 Hofmann ..... A43B 1/0009 36/28
2007/0213838 A1 * 9/2007 Hengelmolen ..... A61F 2/91 623/23.71
2008/0250673 A1 * 10/2008 Andrews ..... A43B 13/12 36/25 R
2009/0117334 A1 * 5/2009 Sogard ..... A61F 2/2412 428/156
2010/0050476 A1 * 3/2010 Elbaz ..... A43C 19/00 36/103
2010/0330330 A1 * 12/2010 Luca ..... B29C 44/5654 428/137
2011/0247237 A1 * 10/2011 Jara ..... A43B 3/0036 36/103

(Continued)

FOREIGN PATENT DOCUMENTS

WO 2010040755 A1 4/2010
WO 2015041796 A1 3/2015

OTHER PUBLICATIONS

International Search Report and Written Opinion dated May 27, 2016 for PCT Application No. PCT/US2015/066917.

*Primary Examiner* — Megan Lynch
(74) *Attorney, Agent, or Firm* — Quinn IP Law

(57) ABSTRACT

An article of footwear has an auxetic sole structure that includes a plurality of apertures. The apertures may include ten sides in an initial configuration, and the number of sides may increase in a second configuration when a force is applied. Adjoining members of the sole structure are hingedly connected, so that they can rotate with respect to each other in the plane of the sole structure. The rotation allows the auxetic sole structure to expand when tension is applied.

10 Claims, 10 Drawing Sheets

(56) References Cited

U.S. PATENT DOCUMENTS

2012/0315456 A1* 12/2012 Scarpa ..... F16F 3/093 428/221
2013/0055596 A1* 3/2013 Wan ..... A43B 13/141 36/25 R
2013/0118036 A1* 5/2013 Gibson ..... A43B 13/223 36/103
2013/0189028 A1* 7/2013 Gershenfeld ..... F16B 3/00 403/345
2013/0303041 A1* 11/2013 Kim ..... A43B 1/0009 442/1
2014/0053311 A1* 2/2014 Nordstrom ..... A41D 1/00 2/69
2014/0059734 A1* 3/2014 Toronjo ..... A41D 31/005 2/69
2014/0101816 A1* 4/2014 Toronjo ..... A41D 31/0011 2/69
2014/0109286 A1* 4/2014 Blakely ..... A41D 31/02 2/69
2014/0114266 A1* 4/2014 Arcand ..... A61F 5/449 604/345
2014/0260281 A1* 9/2014 Innes ..... F23R 3/002 60/752
2015/0075033 A1* 3/2015 Cross ..... A43B 13/22 36/103
2015/0075034 A1* 3/2015 Cross ..... A43B 13/22 36/103
2015/0245683 A1* 9/2015 Cross ..... B32B 27/065 36/103
2015/0245685 A1* 9/2015 Cross ..... A43B 13/187 36/104
2016/0007681 A1* 1/2016 Langvin ..... A43B 5/00 36/103
2016/0025343 A1* 1/2016 Bertoldi ..... F23R 3/002 60/722
2016/0058121 A1* 3/2016 Langvin ..... A43B 5/06 36/103

* cited by examiner

AUXETIC STRUCTURES AND FOOTWEAR WITH SOLES HAVING AUXETIC STRUCTURES

BACKGROUND

The present embodiments relate generally to articles of footwear that may be used for athletic or recreational activities such as running, jogging, training, hiking, walking, volleyball, handball, tennis, lacrosse, basketball and other similar activities.

Articles of footwear can generally be described as having two primary elements, an upper for enclosing the wearer's foot, and a sole structure attached to the upper. The upper generally extends over the toe and instep areas of the foot, along the medial and lateral sides of the foot and around the back of the heel. The upper generally includes an ankle opening to allow a wearer to insert the wearer's foot into the article of footwear. The upper may incorporate a fastening system, such as a lacing system, a hook-and-loop system, or other system for fastening the upper over a wearer's foot. The upper may also include a tongue that extends under the fastening system to enhance adjustability of the upper and increase the comfort of the footwear.

The sole structure is attached to a lower portion of the upper and is positioned between the upper and the ground. Generally, the sole structure may include an insole, a midsole, and an outsole. The insole is in close contact with the wearer's foot or sock, and provides a comfortable feel to the sole of the wearer's foot. The midsole generally attenuates impact or other stresses due to ground forces as the wearer is walking, running, jumping, or engaging in other activities. The midsole may be formed of a polymer foam material, such as a polyurethane (PU), a thermoplastic polyurethane (TPU) or ethylvinylacetate (EVA), that attenuates ground impact forces. In some cases, the midsole may incorporate sealed and fluid-filled bladders that further attenuate and distribute ground impact forces. The outsole may be made of a durable and wear resistant material, and it may carry a tread pattern to provide traction against the ground or playing surface. For some activities, the outsole may also use cleats, spikes or other protrusions to engage the ground or playing surface and thus provide additional traction.

SUMMARY

This summary is intended to provide an overview of the subject matter of this patent, and is not intended to identify essential elements or key elements of the subject matter, nor is it intended to be used to determine the scope of the claimed embodiments. The proper scope of this patent may be ascertained from the claims set forth below in view of the detailed description below and the drawings.

In one aspect, the present disclosure is directed to a structure comprising a group of members attached to one another by a group of connecting portions, where the group of members bound a group of apertures. The group of apertures comprise a first aperture, where the first aperture comprises a first edge, a second edge, a third edge, a fourth edge, a fifth edge, a sixth edge, a seventh edge, an eighth edge, a ninth edge, a tenth edge, an eleventh edge, a twelfth edge, a thirteenth edge, and a fourteenth edge. The first edge is connected to the second edge proximate a first connecting portion of the group of connecting portions, and the first aperture comprises a ten-sided polygon in a first configuration of the members.

In another aspect, the present disclosure is directed to a sole structure for an article of footwear comprising a group of sole members attached to one another by a group of connecting portions, where the group of members bound a group of apertures. The group of apertures comprise a first aperture, and the first aperture comprises a first edge, a second edge, a third edge, a fourth edge, a fifth edge, a sixth edge, a seventh edge, an eighth edge, a ninth edge, a tenth edge, an eleventh edge, a twelfth edge, a thirteenth edge, and a fourteenth edge. The first edge is connected to the second edge proximate a first connecting portion of the group of connecting portions, and the first aperture forms a ten-sided polygon in a first configuration.

In another aspect, the present disclosure is directed to an article of footwear comprising an upper and a sole structure, where the sole structure at least partially comprises an auxetic material. The sole structure includes a plurality of apertures, where the plurality of apertures includes a first aperture, and where the first aperture includes a plurality of edges, including a first edge, a second edge, a third edge, a fourth edge, a fifth edge, a sixth edge, a seventh edge, an eighth edge, a ninth edge, a tenth edge, an eleventh edge, a twelfth edge, a thirteenth edge, and a fourteenth edge. The first edge and the second edge intersect and form a first angle in a first configuration, and the third edge and the fourth edge intersect and form a second angle in the first configuration.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
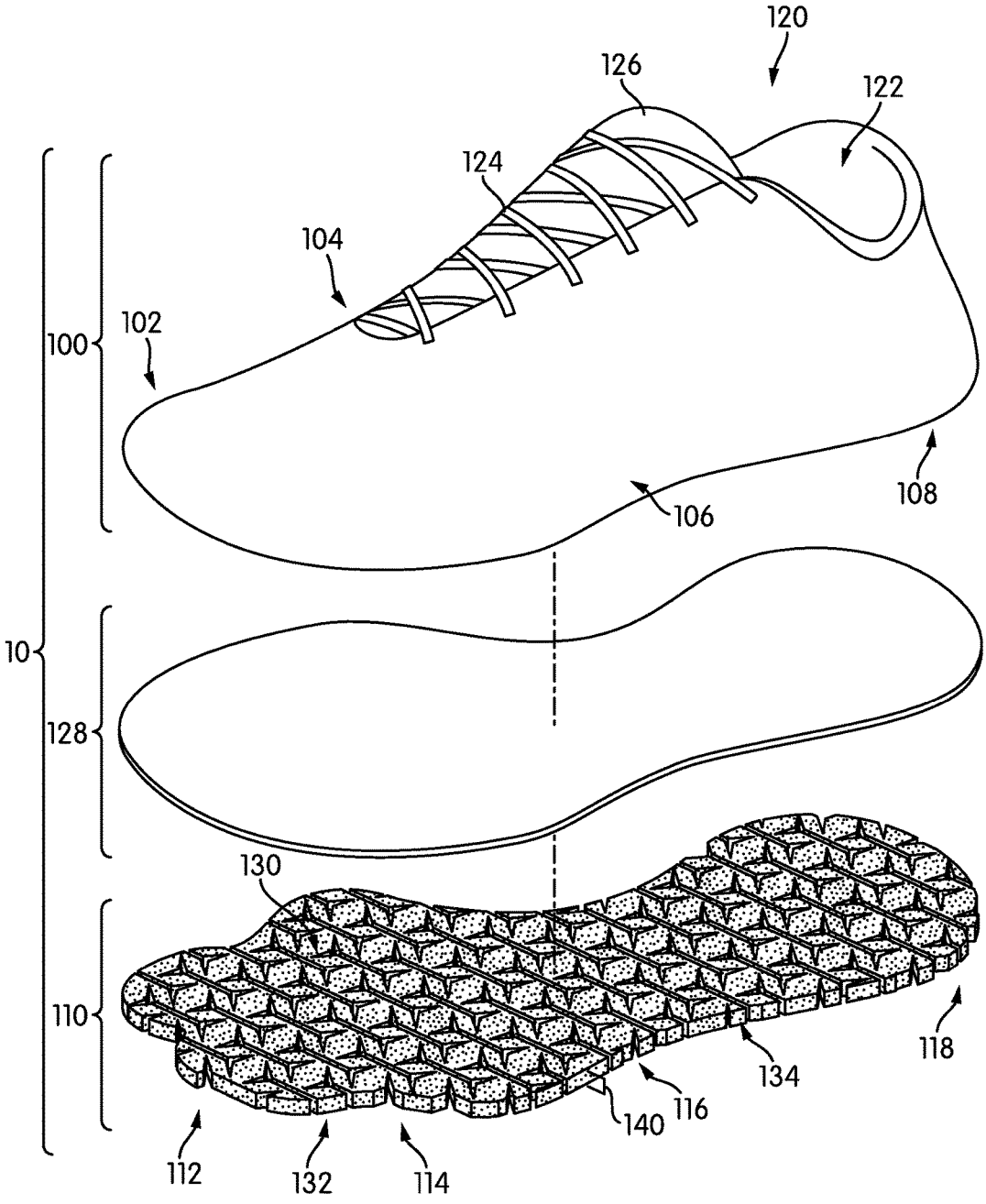
FIG. 1 is an exploded view of an embodiment of an article of footwear.

For clarity, the detailed descriptions herein describe certain exemplary embodiments, but the disclosure in this application may be applied to any article of footwear comprising certain of the features described herein and recited in the claims. In particular, although the following detailed description describes certain exemplary embodiments, it should be understood that other embodiments may take the form of other articles of athletic or recreational footwear.

For convenience and clarity, various features of embodiments of an article of footwear may be described herein by using directional adjectives such as top, bottom, medial, lateral, forward, rear, and so on. Such directional adjectives refer to the orientation of the article of footwear as typically worn by a wearer when standing on the ground, unless otherwise noted. The term "longitudinal" as used throughout this detailed description and in the claims may refer to a direction extending a length of the footwear. In some cases, the longitudinal direction may extend from a forefoot region to a heel region of the article of footwear. Also, the term "lateral" as used throughout this detailed description and in the claims may refer to a direction extending along a width of the article of footwear. In other words, the lateral direction may extend between a lateral side and a medial side of the article of footwear. The term "proximal" may refer to a portion of an article of footwear that is closer to portions of a foot, for example, when the article of footwear is worn. Similarly, the term "distal" may refer to a portion of an article of footwear that is further from a portion of a foot when the article of footwear is worn. The use of these directional adjectives and the depiction of articles of footwear or components of articles of footwear in the drawings should not be understood as limiting the scope of this disclosure in any way.

The terms "top," "upper portion," "upper surface," and other similar terms refer to the portion of an object substantially furthest from the ground in a vertical direction, and the terms "bottom," "bottom surface", "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

FIG. 1 is an isometric exploded view of an article of footwear ("article") 10 that may be used in a number of athletic or recreational activities such as running, walking, training, tennis, volleyball, tennis and racquetball. For reference purposes, an upper 100 of article of footwear 10 may be generally described as having a toe region 102, a forefoot region 104, a midfoot region 106 and a heel region 108. Likewise, article 10 includes a sole structure 110 that may generally be described as having a toe region 112, a forefoot region 114, a midfoot region 116 and a heel region 118. In some embodiments, sole structure 110 may further be characterized as having a top sole surface 130, a bottom sole surface 132 opposite the top sole surface 132, and a side sole surface 134 disposed between top sole surface 130 and bottom sole surface 132.

Upper 100 of article 10 shown in FIG. 1 may be fabricated from any conventional or nonconventional materials, such as leather, woven or non-woven textiles or synthetic leather. Upper 100 has an ankle opening 120 in upper 100 to allow a wearer to insert his or her foot into the interior cavity 122 of upper 100. The wearer may then use a lace 124 to close upper 100 over a tongue 126 to fasten article 10 over his or her foot. Sole structure 110 may be attached to upper 100 by any conventional method, such as stitching, stapling, gluing, fusing or welding or other known method for attaching a sole structure to an upper. Furthermore, in some embodiments, article 10 may include a midsole 128 disposed between sole structure 110 and upper 100. In other embodiments, midsole 128 may differ or may not be included in article 10. It should be noted that additional components may be included in article 10 that are not illustrated here.

The term "sole structure", also referred to simply as "sole", herein shall refer to any combination that provides support for a wearer's foot and bears the surface that is in direct contact with the ground or playing surface, such as a single sole; a combination of an outsole and an inner sole; a combination of an outsole, a midsole and an inner sole, and a combination of an outer covering, an outsole, a midsole and an inner sole. In an exemplary embodiment, sole structure 110 is an outer sole structure configured for contact with a ground surface.

Sole structure 110 as shown in FIG. 1 and as described further in detail below, has an auxetic structure. Articles of footwear having sole structures comprised of an auxetic structure are described in Cross, U.S. patent publication Ser. No. 20150075033, published on Mar. 19, 2015 (now application Ser. No. 14/030,002, filed Sep. 18, 2013), and entitled "Auxetic Structures and Footwear with Soles Having Auxetic Structures" (the "Cross application"), the entirety of which is hereby incorporated by reference. It should be understood that the embodiments described herein with respect to sole structure 110 and its auxetic properties may also be used to describe an auxetic structure independent of a sole structure or a component for an article of footwear. In other words, some embodiments may include a general auxetic structure comprising the properties and features disclosed herein with respect to a sole structure.

In some embodiments, sole structure 110 may be associated with a thickness. In some embodiments, thickness 140 may be characterized as the distance between top sole surface 130 and bottom sole surface 132 of a portion of sole structure 110. In some embodiments, thickness 140 may be less than or equal to the thickness of a midsole. In exemplary embodiments, thickness 140 may range from 0.10 mm to 50.0 mm.

In some embodiments, thickness 140 may be uniform as various portions or sections of sole structure 110 have a uniform distance between top sole surface 130 and bottom sole surface 132. In some other embodiments, thickness 140 throughout sole structure 110 may be variable, as some portions have greater distances between top sole surface 130 and bottom sole surface 132 relative to other portions. The variable thickness may allow for differing degrees of flexibility for sole structure 110. For example, in another embodiment (not shown) the thickness may be greater in a portion corresponding to heel region 118 and less in a portion corresponding to midfoot region 116. In an exemplary embodiment, sole structure 110 has a uniform thickness 140 as the distance between top sole surface 130 and bottom sole surface 132 is substantially the same for the various portions of sole structure 110.

As described in the Cross application, auxetic materials have a negative Poisson's ratio, such that when they are under tension in a first direction, their dimensions increase both in the first direction and in a second direction orthogonal or perpendicular to the first direction. Some of the properties of auxetic materials are illustrated in FIGS. 2 through 10.

Figure 2:
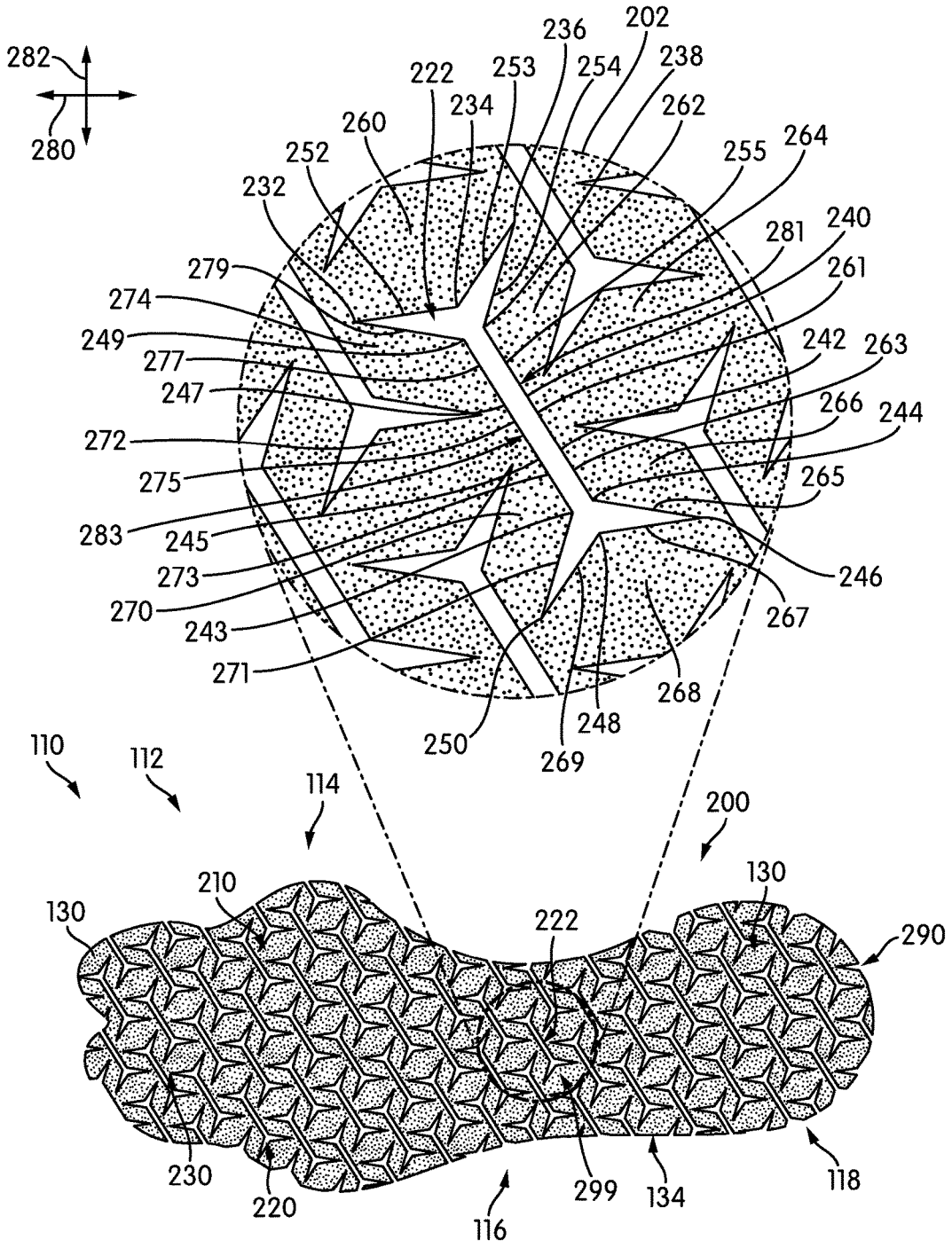
FIG. 2 is a top-down view of an embodiment of a sole structure.

FIG. 2 is a top-down view of an example of a portion of sole structure 110 having an auxetic structure that is not under tension. As shown in the enlarged view, auxetic material 200 comprising sole structure 110 includes a group of "members", also referred to as sole members or members 210 for purposes of convenience. In some embodiments, members 210 are joined by a plurality of vertices 230. In one embodiment, members 210 may be portions or pieces of sole structure 110.

For purposes of clarity, the embodiments herein discuss a subset of members 210 and their relative configuration. However, it will be understood that these particular members are only meant to be a representation and sole structure 110 can be comprised of many other members arranged in similar patterns. Moreover, in other embodiments, members 210 of sole structure 110 may generally be tiled in a regular pattern comprised of smaller sets of additional members that have a configuration substantially similar to members 210.

For example, as shown in a magnified area 202, members 210 may comprise of a first member 260, a second member 262, a third member 264, a fourth member 266, a fifth member 268, a sixth member 270, a seventh member 272, and an eighth member 274. It should be noted that the delineation of members 210 here are for illustrative purposes only. In other embodiments, members 210 may comprise different shapes, sizes, thicknesses, texture, and/or materials. For example, in the embodiment of FIG. 2, members 210 may comprise polygonal portions in sole structure 110. In some embodiments, members 210 may be approximately quadrilateral (i.e., comprise four edges).

As will be discussed further below, in some embodiments, the areas of sole structure 110 that lie between or adjacent to members 210 may define a group of interior apertures ("apertures") 220. In some cases, only a portion or one edge of a member may bound an aperture. For example, referring to FIG. 2, in some embodiments, first member 260, second member 262, third member 264, fourth member 266, fifth member 268, sixth member 270, seventh member 272, and eighth member 274, based on their location, geometry and common vertices may define and circumscribe a first aperture 222.

In some embodiments, apertures 220 may have a ten-sided shape. In an exemplary embodiment the shapes of apertures 220 are a generally linear middle portion having two-pronged tapered tails at each opposing end. In some other embodiments, the shapes may differ significantly from those shown here (see discussion of FIGS. 7-10 below). It should be noted that in other embodiments, the shapes of members 210 may differ significantly from those shown here (see discussion of FIGS. 7-10 below), and any neighboring apertures 220 may also differ in shape.

In different embodiments, an aperture may include several vertices, associated with the intersection of various edges. In one example, first aperture 222 may be associated with a plurality of vertices 299. In FIG. 2, first aperture 222 includes a first vertex 232, a second vertex 234, a third vertex 236, a fourth vertex 238, a fifth vertex 240, a sixth vertex 242, a seventh vertex 244, an eighth vertex 246, a ninth vertex 248, a tenth vertex 250, an eleventh vertex 243, a twelfth vertex 245, a thirteenth vertex 247, and a fourteenth vertex 249. It should be understood that the vertices discussed herein may not be readily apparent in some configurations of sole structure 110, and may be more apparent in other configurations of sole structure 110 (for example, when sole structure 110 undergoes auxetic expansion).

In some embodiments, the material of sole members that are proximate various vertices 299 of an aperture may also function as hinges. In one embodiment, adjacent portions of material, including one or more geometric portions (e.g., polygonal portions), may rotate about a hinge portion associated with a vertex of the aperture. Thus, portions or members 210 may be hingedly connected in some embodiments. The angles associated with vertices where hinging occurs may change as the structure contracts or expands. However, in some embodiments, one or more vertices 299 may not function as a hinge for corresponding sides or edges. For example, some of vertices 299 may be static such that the angle of the vertex remains approximately unchanged during auxetic expansion. These features of sole structure 110 will be discussed in greater detail below with respect to FIGS. 5 and 6.

It should be understood that in some embodiments, the apertures arranged on an outsole or bottom sole surface 132 of sole structure 110 (as shown in FIG. 1) may match or correspond to the apertures 220 of top sole surface 130 of sole structure 110. In other words, apertures 220 may be open on both top sole surface 130 and bottom sole surface 132 (as shown in FIG. 1), and they may continue to extend through the thickness of sole structure 110 as any auxetic expansion occurs. In some embodiments, such apertures extending through sole structure 110 may be referred to as "through-hole" apertures.

In some embodiments, members 210 of sole structure 110 may further define a group of peripheral apertures ("peripheral apertures") 290. Peripheral apertures 290 may be disposed between members at a common vertex. In some embodiments, peripheral apertures 290 may be characterized as being an abbreviated or cut-off portion of apertures 220. In still some other embodiments, peripheral apertures 290 may take on other shapes based on different geometries of sole structure 110. It should be understood that peripheral apertures 290 are not meant to define a precise location along a periphery of sole structure 110. Rather, peripheral apertures 290 describe apertures that are generally disposed around the periphery of sole structure 110. In some embodiments, peripheral apertures 290 may all have uniform sizes and shapes. In some other embodiments, peripheral apertures 290 may have different sizes and different shapes. For example, some peripheral apertures 290 may be open along one or more sides. In the embodiment of FIG. 2, peripheral apertures 290 form openings along the perimeter of sole structure 110. In other words, peripheral apertures 290 create additional edges and/or recesses within a side sole surface 134, such that side sole surface 134 is jagged. In other embodiments, the location and design of peripheral apertures may differ such that they are entirely contained within the boundary established by a side sole surface 734 (see FIGS. 7-10).

In some embodiments, apertures 220 may include a plurality of edges or sides. In some embodiments, first aperture 222 may comprise of a first edge 252, a second edge 253, a third edge 254, a fourth edge 255, a fifth edge 261, a sixth edge 263, a seventh edge 265, an eighth edge 267, a ninth edge 269, a tenth edge 271, an eleventh edge 273, a twelfth edge 275, a thirteenth edge 277, and a fourteenth edge 279. It should be noted that the edges described herein are for the purposes of convenience, and apertures 220 may have a number of sides less than or greater than those of the edges described here.

Figure 3:
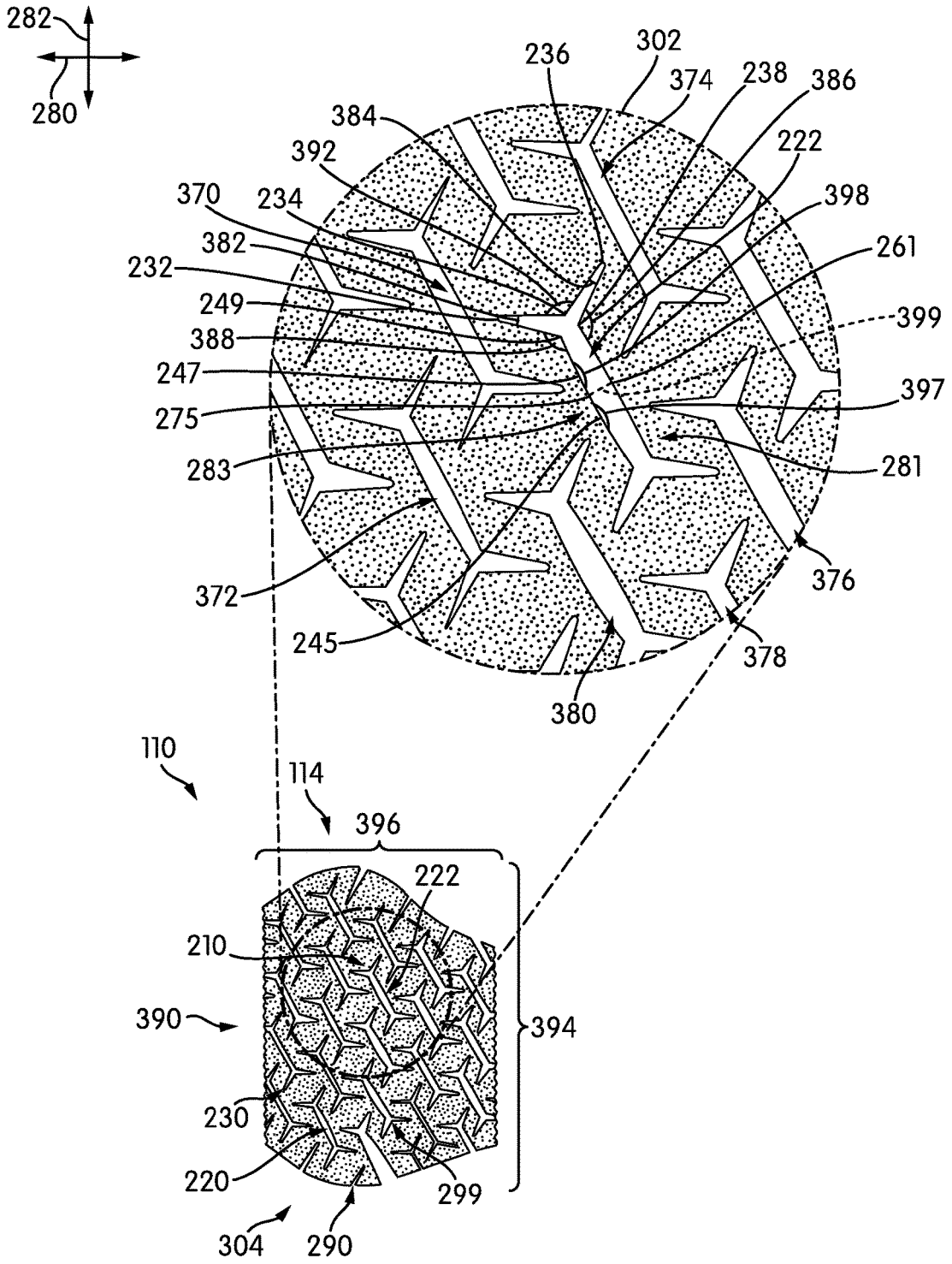
FIG. 3 is a top-down view of an embodiment of a portion of the sole structure in FIG. 2.
Figure 4:
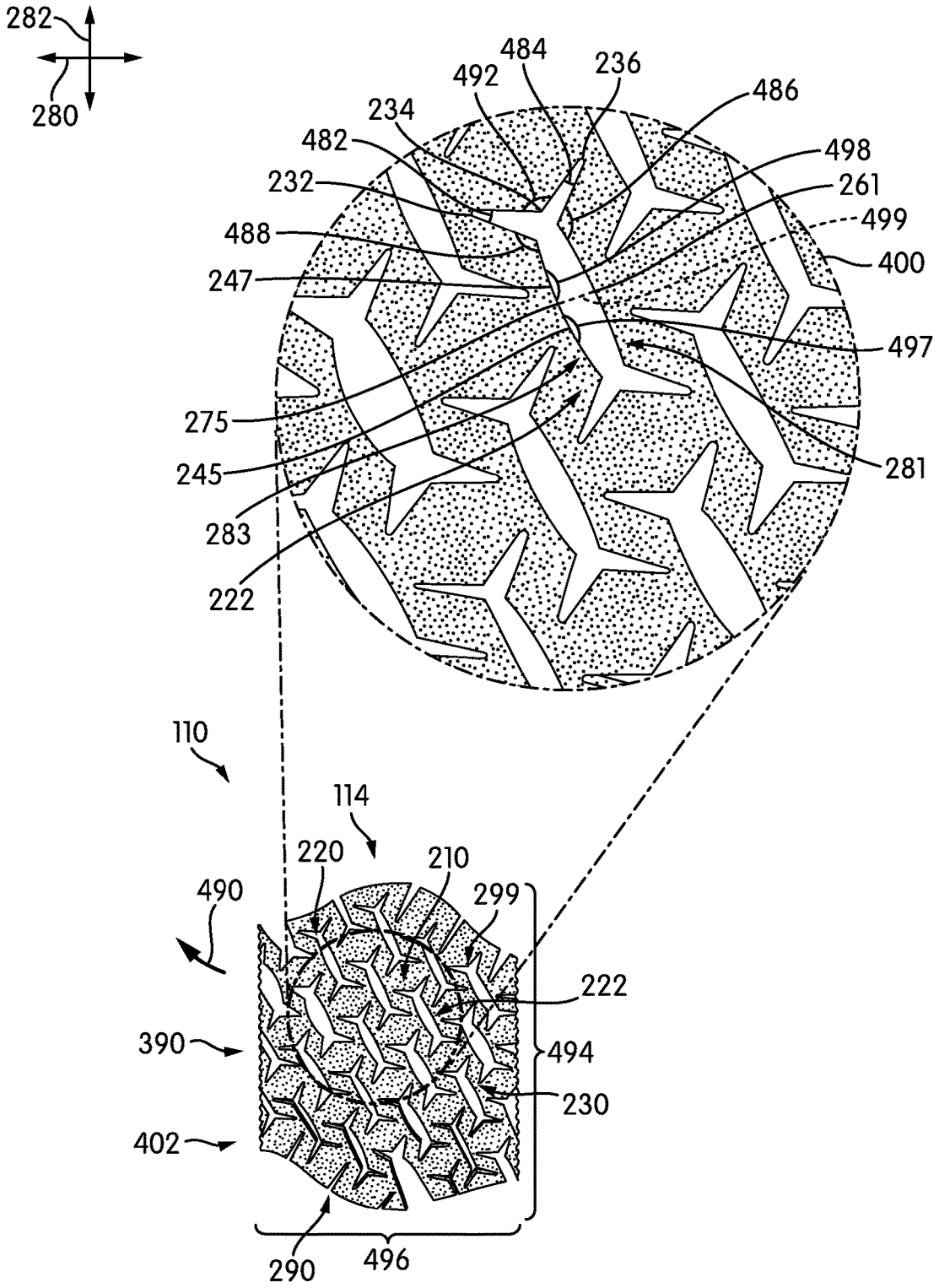
FIG. 4 is a top-down view of an embodiment of a portion of the sole structure in FIG. 2 undergoing a first tension.
Figure 5:
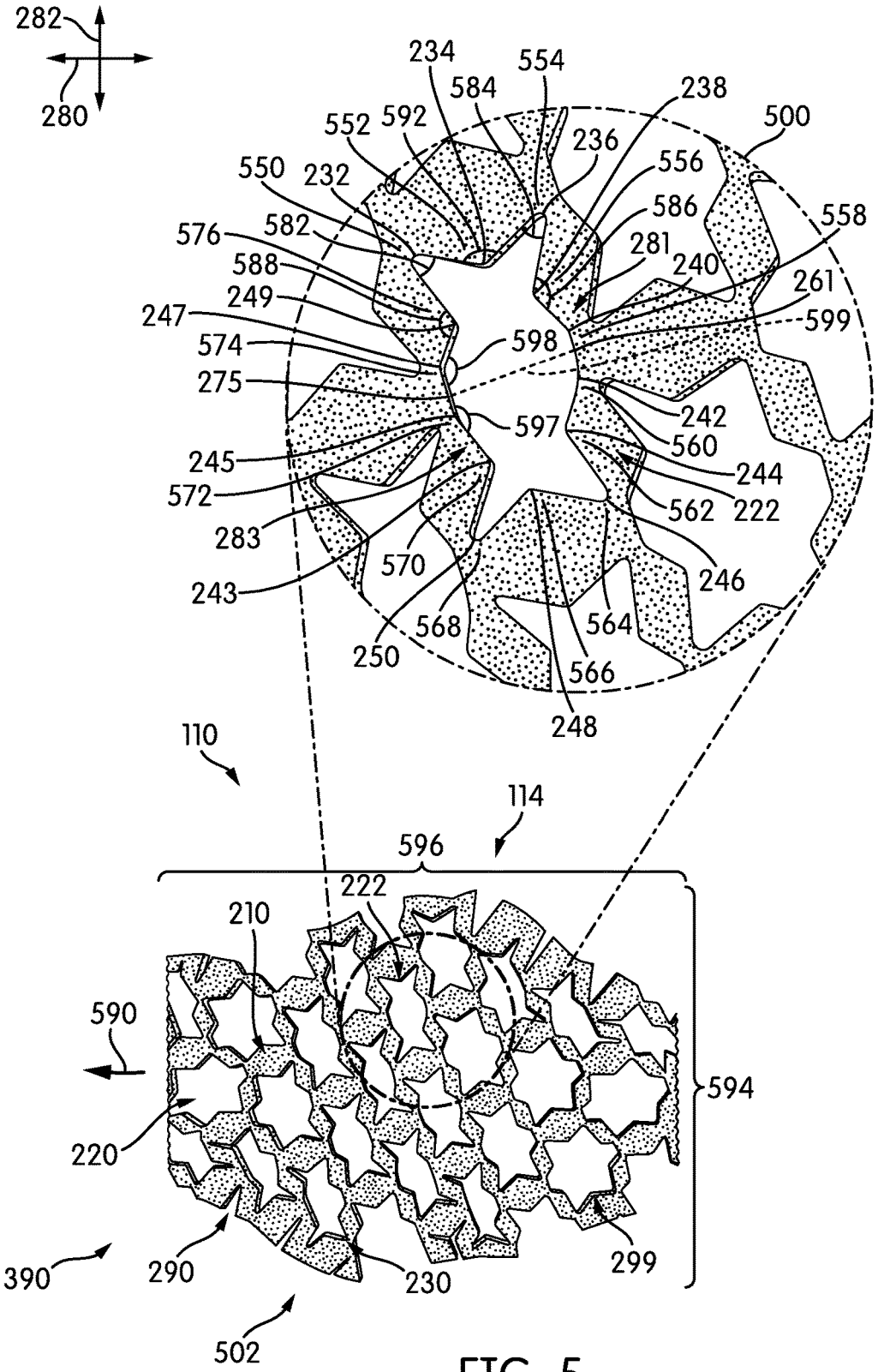
FIG. 5 is a top-down view of an embodiment of a portion of the sole structure in FIG. 2 undergoing a second tension.
Figure 6:
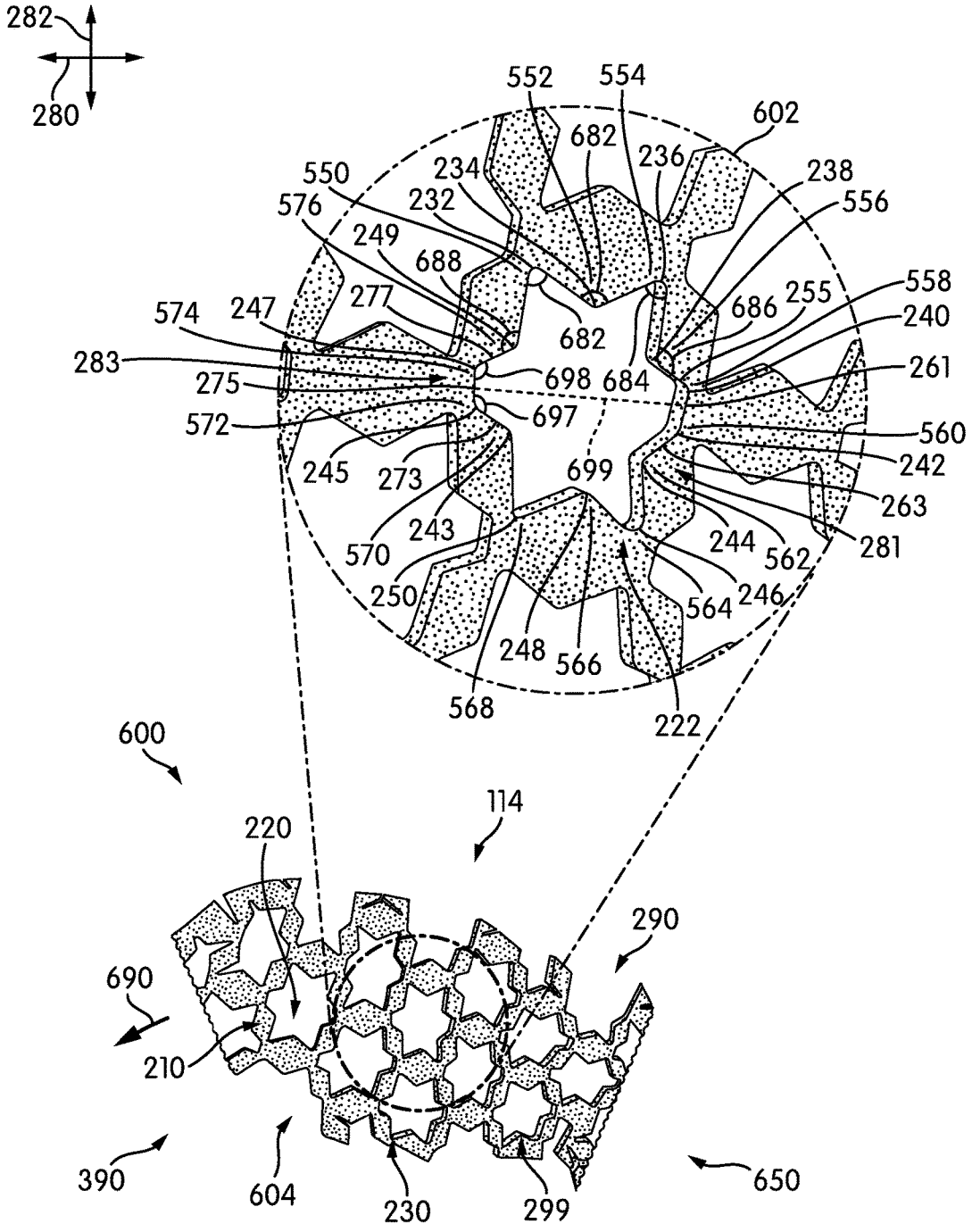
FIG. 6 is a top-down view of an embodiment of a portion of the sole structure in FIG. 2 undergoing a third tension.

It should be noted that the designation of different edges in FIGS. 2-4 may be more clearly distinguished in the open configuration illustrated in FIGS. 5 and 6. In other words, as sole structure 110 undergoes an auxetic expansion, apertures 220 may transition between a "closed" configuration to an "open" configuration, such that the edges described herein become more apparent (see FIGS. 5 and 6).

In some embodiments, the various edges of apertures 220 may be associated with a dimension such as a length or width. For example, in some embodiments, first edge 252, second edge 253, third edge 254, fourth edge 255, fifth edge 261, sixth edge 263, seventh edge 265, eighth edge 267, ninth edge 269, tenth edge 271, eleventh edge 273, twelfth edge 275, thirteenth edge 277, and fourteenth edge 279 may each be associated with a length. Each length of each edge may be similar or each length may be substantially greater or smaller than a neighboring edge length. In some embodiments, two or more edges could have similar lengths (e.g., fourth edge 255 and thirteenth edge 277 may be substantially equal in length as best seen in FIG. 6). In some embodiments, two or more edges could differ in length (e.g., the length of fifth edge 261 may be smaller than the length of first edge 252).

In some embodiments, edges of a member may be linear. In other embodiments, as shown further below, the edges of a member may be rounded, curved, or otherwise irregularly formed. In some other embodiments, a member may have edges which may be non-linear, contoured, rounded, or wavy. In an exemplary embodiment, first edge 252, second edge 253, third edge 254, fourth edge 255, fifth edge 261, sixth edge 263, seventh edge 265, eighth edge 267, ninth edge 269, tenth edge 271, eleventh edge 273, twelfth edge 275, thirteenth edge 277, and fourteenth edge 279 are substantially straight to form a ten-sided polygon aperture.

In one embodiment, the portion of first aperture 222 associated with the main (middle) body of first aperture 222 can comprise of fourth edge 255, fifth edge 261, sixth edge 263 on a first side 281, and eleventh edge 273, twelfth edge 275, thirteenth edge 277 along an opposing second side 283. In some embodiments, first side 281 and second side 283 can be substantially similar in length. In other embodiments, first side 281 and second side 283 may differ in length. In one embodiment, first side 281 and second side 283 may be substantially parallel to one another, while in other embodiments, first side 281 and second side 283 may be disposed at an angle with respect to one another.

Apertures 220 may be associated with an orientation along sole structure 110. For example, in FIG. 2, apertures 220 are arranged such that first side 281 and second side 283 lie in a diagonal plane relative to a longitudinal direction 280 and a lateral direction 282. In other embodiments, apertures 220 may be arranged such that first side 281 and second side 283 are orthogonal with respect to longitudinal direction 280 or lateral direction 282.

Edges of members 210 may vary in their relative orientation (e.g., their angular orientation). In some embodiments, members 210 may have two or more edges that are parallel. For example, fourth edge 255 and thirteenth edge 277 may be substantially parallel. In some embodiments there may be edges that are at an angle with respect to one another. In one embodiment, edges may intersect or otherwise make contact with each other. For example, in FIG. 2, first edge 252 and second edge 253 intersect and form an obtuse angle at their vertex. Thus, the edges can be disposed in various orientations throughout sole structure 110.

FIG. 3 is an illustration of a portion 390 of sole structure 110 shown in FIG. 2. In some embodiments, when sole structure 110 is not under tension in any direction (an initial or first configuration 304), portion 390 of sole structure 110 with members 210 may have a first length 396 and first width 394. In other embodiments, during this resting state, vertices 299 or edges that form members 210 which enclose or circumscribe apertures 220 may be separated from one another by certain distances. In some embodiments, one or more edges may be separated by various separation distances. For example, in some embodiments, fifth edge 261 and twelfth edge 275 may be separated by a first separation distance 399.

In some embodiments, as described above, there may be multiple apertures 220. For example, as shown in a magnified area 302, first aperture 222 may be disposed such that it neighbors or is surrounded by a second aperture 370, a third aperture 372, a fourth aperture 374, a fifth aperture 376, a sixth aperture 378, and a seventh aperture 380. In other embodiments, first aperture 222 may be surrounded by a fewer or greater number of apertures 220.

Apertures 220 may have the same size and shape, or they may differ in some embodiments. In some other embodiments, first aperture 222, second aperture 370, third aperture 372, fourth aperture 374, fifth aperture 376, sixth aperture 378, and seventh aperture 380 may have the same sizes and shapes. In still some other embodiments, first aperture 222, second aperture 370, third aperture 372, fourth aperture 374, fifth aperture 376, sixth aperture 378, and seventh aperture 380 may have different sizes and shapes. In one embodiment, for example, third aperture 372 can have a different shape but be similar in size to first aperture 222. In another embodiment, third aperture 372 may have a different size but comprise a similar shape to first aperture 222.

Furthermore, apertures 220 may have various areas and dimensions. For example, in the embodiment of FIG. 3, first aperture 222 has a first separation distance 399 associated with the distance across first aperture 222 from fifth edge 261 to twelfth edge 275. In other embodiments, as discussed below, the separation distances between various edges of apertures 220 may increase or decrease as a result of the auxetic properties of sole structure 110.

In some embodiments, the shape of first aperture 222 may include various interior or exterior angles. In an exemplary embodiment, first aperture 222 may include a first angle 382 associated with first vertex 232, a second angle 384 associated with third vertex 236, a third angle 386 associated with fourth vertex 238, a fourth angle 388 associated with fourteenth vertex 249, and a fifth angle 392 associated with second vertex 234. In some embodiments, the angles may be different from each other. In some other embodiments, all the angles may be equal or they may be oblique. In still some other embodiments, only some of the angles may be equal. In an exemplary embodiment, third angle 386, fourth angle 388, and fifth angle 392 can be substantially equal. In another embodiment, third angle 386, fourth angle 388, and fifth angle 392 may be different from one another. Furthermore, in one embodiment, as seen in FIG. 3, first angle 382 and second angle 384 may be substantially similar or they may differ. It should be understood that first angle 382, second angle 384, third angle 386, fourth angle 388, fifth angle 392, and other angles described herein are intended to be representative of various portions of first aperture 222. In some embodiments, the angles may form linear edges, such that the angle is approximately 180 degrees. For example, a sixth angle 397 associated with twelfth vertex 245 and a seventh angle 398 associated with thirteenth vertex 247 may each be close to or equal to 180 degrees. In other words, eleventh edge 273 and twelfth edge 275 may be aligned in a substantially linear way, and/or twelfth edge 275 and thirteenth edge 277 may be aligned in a substantially linear manner in some embodiments.

In some embodiments, angles associated with various portions of first aperture 222 may increase or decrease. For example, each of the angles associated with first vertex 232, second vertex 234, third vertex 236, fourth vertex 238, fifth vertex 240, sixth vertex 242, seventh vertex 244, eighth vertex 246, ninth vertex 248, tenth vertex 250, eleventh vertex 243, twelfth vertex 245, thirteenth vertex 247, and fourteenth vertex 249 can change as tension is applied or experienced by sole structure 110.

FIGS. 4-6 illustrate a sequence of configurations for portion 390 of sole structure 110 when various forces or tensions are applied. As noted above, in some embodiments, the geometry and arrangement of members 210 may provide auxetic properties to sole structure 110 when a force is applied. While the discussion below describes the effect on apertures 220 during auxetic expansion, it should be noted that members 210 may rotate about vertices 230 as a part of this process, such that the rotation of members 210 can allow differences in aperture size, shape, and angle to occur. Thus, the rotation of members 210 may at least in part facilitate the changes in sole structure 110.

It should be understood that in other embodiments (not shown here), sole structure 110 may be compressed in the vertical direction. In some cases, a force applied along a vertical direction may cause apertures to narrow and/or close. In other words, while members 210 may expand when sole structure 110 experiences a compressive force in the vertical direction, the apertures in sole structure 110 may decrease in size.

As illustrated in FIG. 4, in a second configuration 402, members 210 are shown to be under a first tension 490. In second configuration 402, first tension 490 causes apertures 220 to expand at least in part due to the auxetic structure. This in turn allows the distances between edges to either increase or decrease depending on the geometry of apertures 220 and the orientation of members 210. For example, as shown in a magnified area 400, a second separation distance 499 is now associated with the distance across first aperture 222 from fifth edge 261 to twelfth edge 275. Second separation distance 499 is greater than first separation distance 399 in FIG. 3. The overall (cross-sectional) area of first aperture 222 can be seen to be increasing as the applied tension is increased from FIG. 3 to FIG. 4. In addition, in some embodiments, when sole structure 110 is under first tension 490, portion 390 of sole structure 110 with members 210 may have a second length 496 and second width 494. In the embodiment of FIG. 4, second length 496 is greater than first length 396 of FIG. 3, and second width 494 is greater than first width 394. Thus, portion 390 of sole structure 110 can expand in size as tension is applied.

Furthermore, angles associated with different portions of first aperture 222 can change as a result of first tension 490. In FIG. 4, a first angle 482, a second angle 484, a third angle 486, a fourth angle 488, a fifth angle 492, a sixth angle 497, and a seventh angle 498 are shown. In this case, comparing the magnitudes of the angles between FIG. 3 (at rest) and FIG. 4 (under first tension 490), it can be seen that first angle 482 is greater than first angle 382, and second angle 484 is greater than second angle 384. In addition, a sixth angle 497 is associated with a curve that is slightly smaller than sixth angle 397, and a seventh angle 498 is associated with a curve that is slightly smaller than seventh angle 398. Some angles, such as fifth angle 492, may not significantly change as tension is applied to sole structure 110.

In FIG. 5, a third configuration 502 is shown, where members 210 are under a second tension 590. Second tension 590 is greater than first tension 490. In third configuration 502, second tension 590 causes apertures 220 to expand further as a result of the auxetic structure. This in turn alters the distances between edges, so that the distances each either increase or decrease depending on the geometry of apertures 220 and the orientation of members 210. For example, as shown in a magnified area 500, a third separation distance 599 is now associated with the distance across first aperture 222 from fifth edge 261 to twelfth edge 275. Third separation distance 599 is greater than second separation distance 499 in FIG. 4. The overall area of first aperture 222 can be seen to be increasing as the applied tension is increased from FIG. 4 to FIG. 5. In addition, in some embodiments, when sole structure 110 is under second tension 590, portion 390 of sole structure 110 with members 210 may have a third length 596 and third width 594. In the embodiment of FIG. 4, third length 596 is greater than second length 496 of FIG. 4, and third width 594 is greater than second width 494. Thus, portion 390 of sole structure 110 can further expand in size as greater tension is applied.

Furthermore, angles associated with different portions of first aperture 222 have also changed as a result of second tension 590. In FIG. 5, a first angle 582, a second angle 584, a third angle 586, a fourth angle 588, a fifth angle 592, a sixth angle 597, and a seventh angle 598 are shown. In this case, comparing the magnitudes of the angles between FIG. 4 (under first tension 490) and FIG. 5 (under second tension 590), it can be seen that first angle 582 is greater than first angle 482, and second angle 584 is greater than second angle 484. In addition, a sixth angle 597 is associated with a curve that is smaller than sixth angle 497, and a seventh angle 598 is associated with a curve that is smaller than seventh angle 498.

In FIG. 6, a fourth configuration 600 is shown, where members 210 are under a third tension 690. It should be noted that in order to better depict the embodiment, a smaller portion 650 (e.g., a sub-portion of portion 390) of sole structure 604 is now shown. Third tension 690 is greater than second tension 590. In fourth configuration 600, third tension 690 causes apertures 220 to expand further as a result of the auxetic structure. This in turn changes the distances between various edges of first aperture 222, so that the distances each either increase or decrease depending on the geometry of apertures 220 and the orientation of members 210. For example, as shown in a magnified area 602, a fourth separation distance 699 is now associated with the distance across first aperture 222 from fifth edge 261 to twelfth edge 275. Fourth separation distance 699 is greater than third separation distance 599 in FIG. 5. The overall area of first aperture 222 can be seen to be increasing as the applied tension is increased from FIG. 5 to FIG. 6.

As discussed previously with respect to FIG. 2, in some embodiments, the material of the sole members that are proximate various vertices 299 of an aperture may also function as hinges and can provide a mechanism for expansion portions of sole structure 110. In other words, members 210 may be hingedly connected in some embodiments. As best represented in FIGS. 5 and 6, in different embodiments, there may be additional portions of members 210 that more particularly function as a hinges, associated with vertices of apertures 220. In one embodiment, some vertices can join a relatively small portion of material of sole structure 110 (e.g., a small portion of members 210) in a rotatable manner. Thus, some embodiments of sole structure 110 may include provisions for joining members 210 or portions of members 210 to one other and/or rotating adjacent members 210 with respect to one other.

For example, first aperture 222 may include a connecting portion near one or more of its vertices. In FIGS. 5 and 6, a first connecting portion 550, a second connecting portion 552, a third connecting portion 554, a fourth connecting portion 556, a fifth connecting portion 558, a sixth connecting portion 560, a seventh connecting portion 562, an eighth connecting portion 564, a ninth connecting portion 566, a tenth connecting portion 568, an eleventh connecting portion 570, a twelfth connecting portion 572, a thirteenth connecting portion 574, and a fourteenth connecting portion 576 can be seen. Connecting portions are comprised of a relatively small portion of material adjacent to one or more vertices of each aperture.

In some embodiments, connecting portions may allow members 210 or other portions of sole structure 110 to rotate with respect to one another in a plane of the sole structure. Thus, during expansion of auxetic material 200, one or more of the vertices of apertures 220 can be associated with connecting portions that move in a rotatable manner. In some embodiments, the rotation of members 210 may provide sole structure 110 with auxetic properties. In other embodiments, apertures 220 may not include a vertex with a connecting portion. In still other embodiments, apertures 220 may include a greater number of vertices with adjacent connecting portions or a lesser number of connecting portions than illustrated herein. Thus, as seen in the transition of portion 390 of sole structure 110 from third configuration 502 in FIG. 5 to fourth configuration 600 in FIG. 6, connecting portions may allow members 210 to rotate with respect to one another in a horizontal plane of sole structure 110.

Furthermore, angles associated with different portions of first aperture 222 have also changed as a result of third tension 690 between third configuration 502 in FIG. 5 and fourth configuration 600 in FIG. 6. In FIG. 6, a first angle 682, a second angle 684, a third angle 686, a fourth angle 688, a fifth angle 692, a sixth angle 697, and a seventh angle 698 are shown. In this case, comparing the magnitudes of the angles between FIG. 5 (under second tension 590) and FIG. 6 (under third tension 690), it can be seen that first angle 682 is greater than first angle 582, and second angle 684 is greater than second angle 584. In addition, a sixth angle 697 is associated with a curve that is smaller than sixth angle 597, and a seventh angle 698 is associated with a curve that is smaller than seventh angle 598.

In addition, it can be seen that first aperture 222 has transitioned from a ten-sided polygon to a fourteen-sided polygon over the expansion sequence illustrated in FIGS. 3-6. Thus, in some embodiments, as various forces are applied, one or more apertures 220 may change shape dramatically. For example, in the embodiment of FIG. 2, first side 281 comprising of fourth edge 255, fifth edge 261, and sixth edge 263, and second side 283 comprising of eleventh edge 273, twelfth edge 275, and thirteenth edge 277 are illustrated. Both first side 281 and second side 283 are substantially linear. However, during the transition shown in FIGS. 3-6, an increased tension is applied to first aperture 222, such that first side 281 and second side 283 each form a non-linear (bent) portion.

It should be noted that in some embodiments, various applied tensions may also transform peripheral apertures 290 (see FIG. 2) from their initial size and shape during the resting stage to a different size and shape as members 210 are rotated. As shown in FIG. 6, the size of peripheral apertures 290 may increase as third tension 690 is applied. Thus, peripheral apertures 290 may be wider or have different angles in one configuration versus another.

Figure 7:
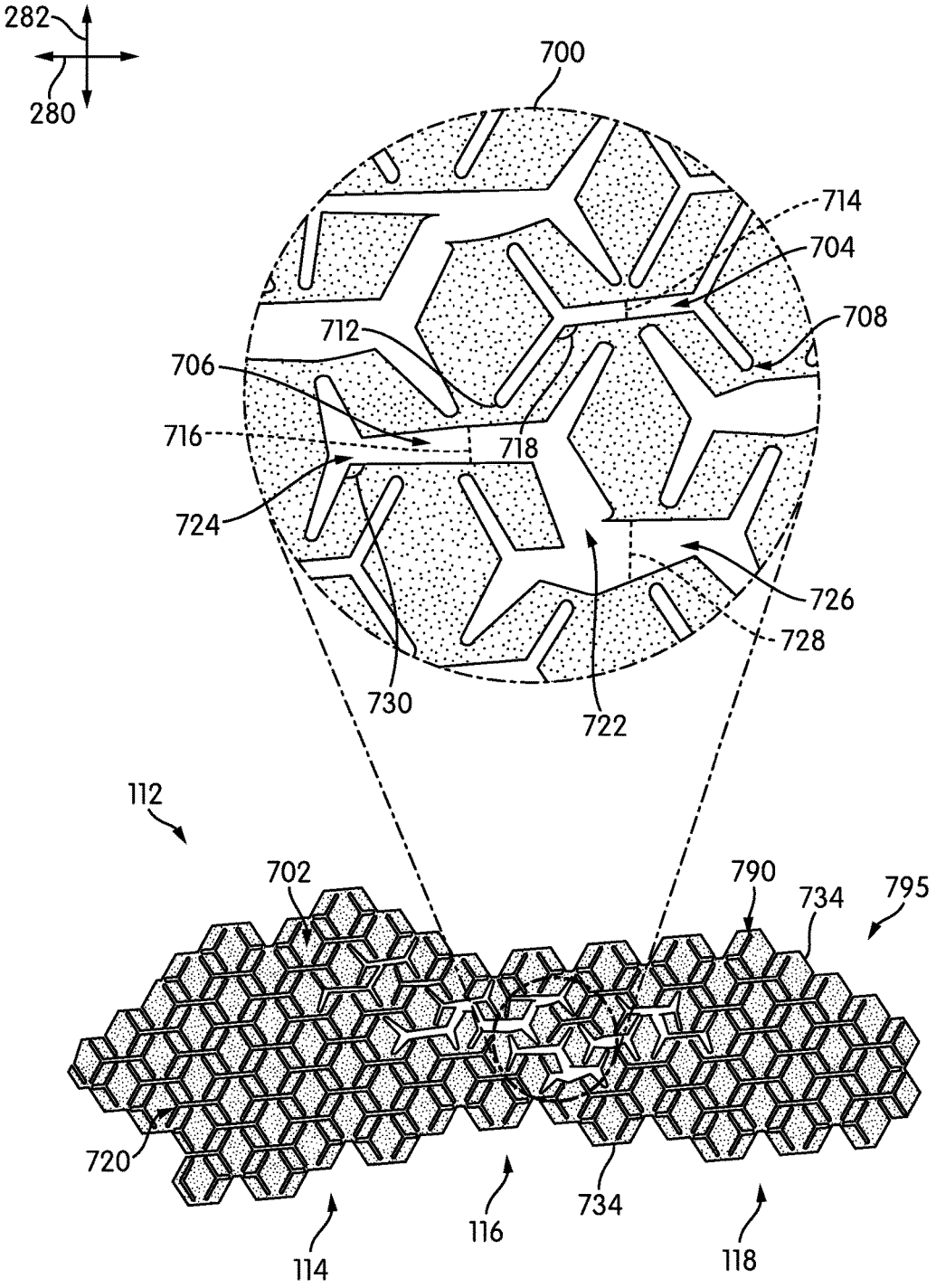
FIG. 7 is a top-down view of an embodiment of a sole structure.

It should also be noted that in different embodiments, the geometry of the apertures can vary. Variations in the shapes of an aperture can alter the auxetic properties of the material. Thus, changing the shape of an aperture can provide a different expansion sequence to a sole structure. For example, a second sole structure 710 is depicted in FIGS. 7-10. Second sole structure 710 is at rest in an initial or first configuration 795. FIG. 7 illustrates an embodiment of a group of sole members ("members") 702 that have a similar geometry to members 210 of FIG. 2. However, in this case, members 702 are adjacent to one or more apertures 720 that differ from apertures 220 (see FIG. 2).

Referring to FIG. 7, in an exemplary embodiment, a magnified area 700 depicts a first aperture 704 and a second aperture 706. It can be seen that first aperture 704 includes one or more vertices 708 that differ significantly from vertices 230 of FIG. 2. For example, a first vertex 712 where two edges join in FIG. 7 is more rounded and curved than first vertex 232 of FIG. 2, which included a sharper or more pointed angle. Thus, the tapered triangular ends of apertures 220 in FIG. 2 can differ from the generally constant width of the ends of apertures 720 in FIG. 7.

Furthermore, some apertures 720 may be formed such that they include up to twice the cross-sectional area of apertures 220 of FIG. 2. As seen in FIG. 7, a second aperture 706 extends from a first segment 724 to a second segment 726 across an aperture arm 722. Both first segment 724 and second segment 726 comprise an area similar to the area of first aperture 704. Thus, apertures 720 may be formed in some embodiments that are significantly greater in area and/or shape than other apertures. For example, second aperture 706 includes a first separation distance 716 and a second separation distance 728, while first aperture 704 includes a third separation distance 714. Second separation distance 728 is greater than first separation distance 716, and third separation distance 714 is smaller than first separation distance 716. In addition, the angles associated with vertices 708 may differ among apertures 720. For example, first angle 718 of first aperture 704 is greater than a corresponding second angle 730 of second aperture 706. Thus, within a single sole structure there may be apertures of various dimensions and/or geometry.

In some embodiments, members 702 of second sole structure 710 may further define a group of peripheral apertures ("peripheral apertures") 790. Peripheral apertures 790 may be disposed between members at a common connecting portion or adjacent to vertices. In some embodiments, peripheral apertures 790 may be characterized as being an abbreviated or cut-off portion of apertures 720. In still some other embodiments, peripheral apertures 790 may take on other shapes based on different geometries of sole structure 710. It is understood that peripheral apertures 790 are not meant to define a location along a periphery of sole structure 710 but is merely meant to convey a descriptive term relative to their location to members 702 and apertures 720 located in the interior of sole structure 710. In some embodiments, peripheral apertures 790 may all have uniform sizes and shapes. In some other embodiments, peripheral apertures 290 may have different sizes and different shapes. In the embodiment of FIG. 7, peripheral apertures 790 remain entirely enclosed or bounded within second sole structure 710. In other words, peripheral apertures 790 do not create additional edges and/or recesses within side sole surface 734, such that side sole surface 734 remains substantially continuous and unbroken.

It should be further noted that in the embodiment of FIG. 2, side sole surface 134 is cut such that sole structure 110 is curved and smooth. However, the embodiment of FIG. 7 illustrates an example of a sole structure where side sole surface 734 is cut to maintain the shapes of members 702 consistently across second sole structure 710.

Figure 8:
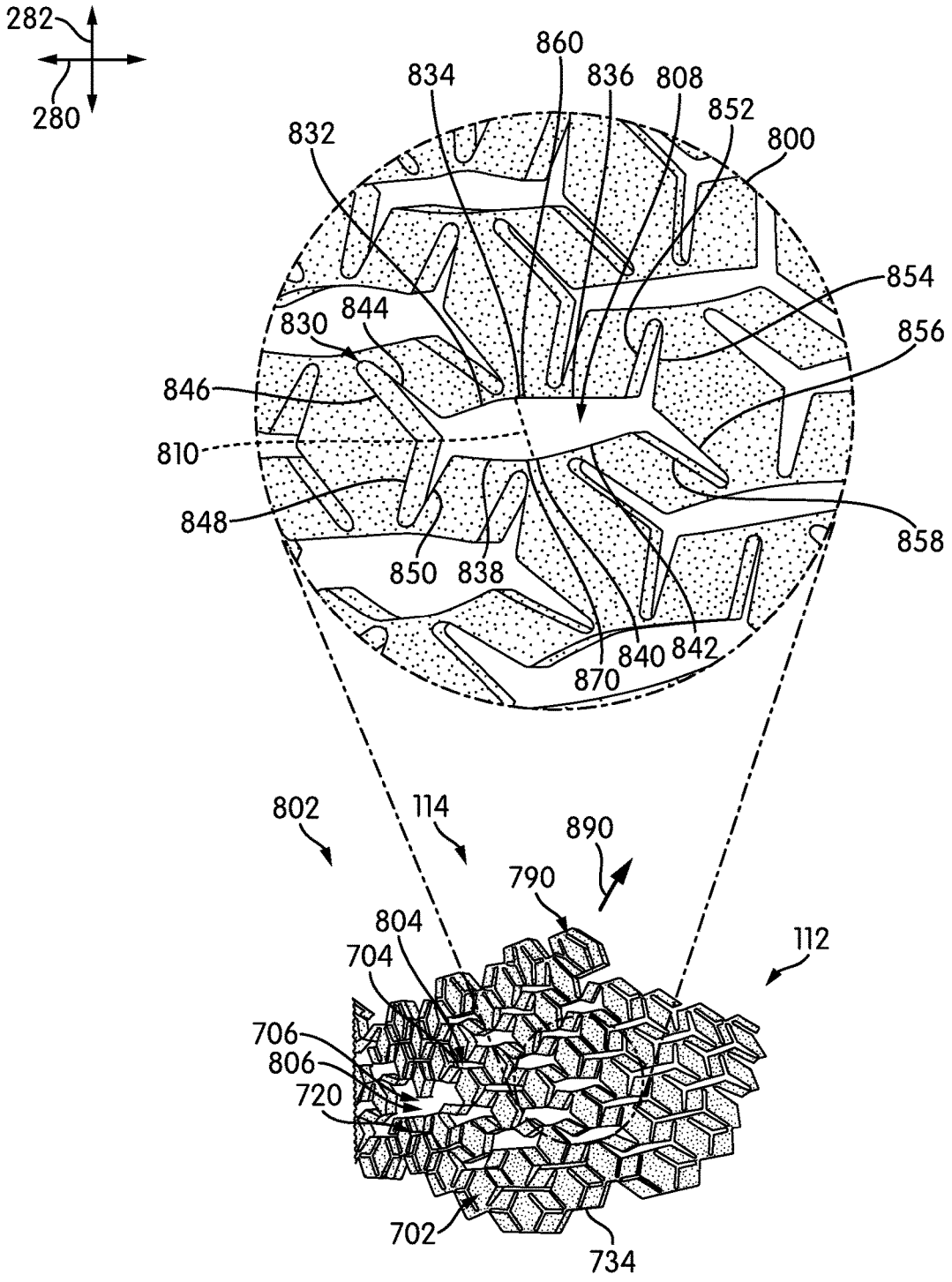
FIG. 8 is a top-down view of an embodiment of a portion of the sole structure in FIG. 7 undergoing a first tension.
Figure 9:
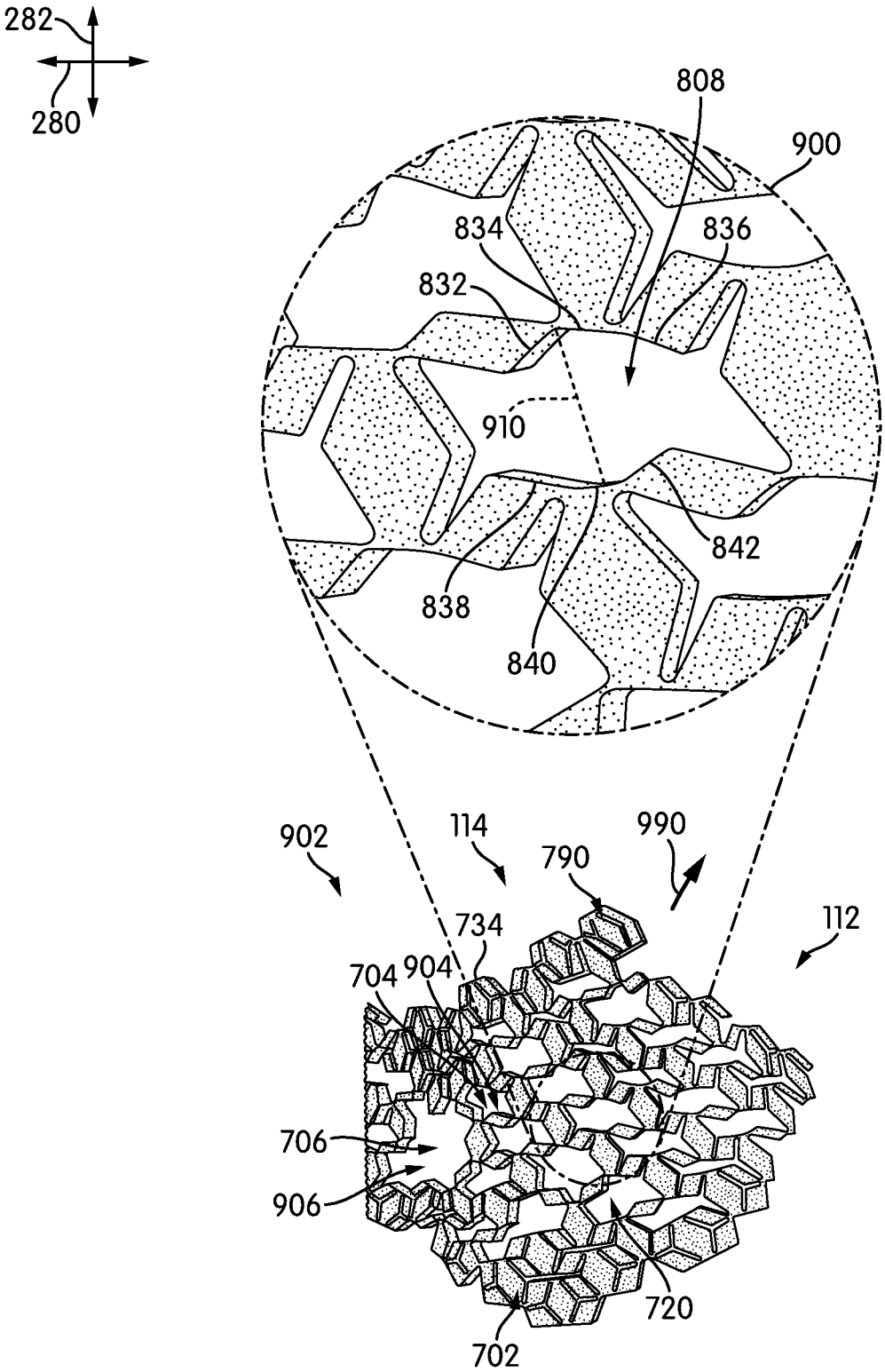
FIG. 9 is a top-down view of an embodiment of a portion of the sole structure in FIG. 7 undergoing a second tension.
Figure 10:
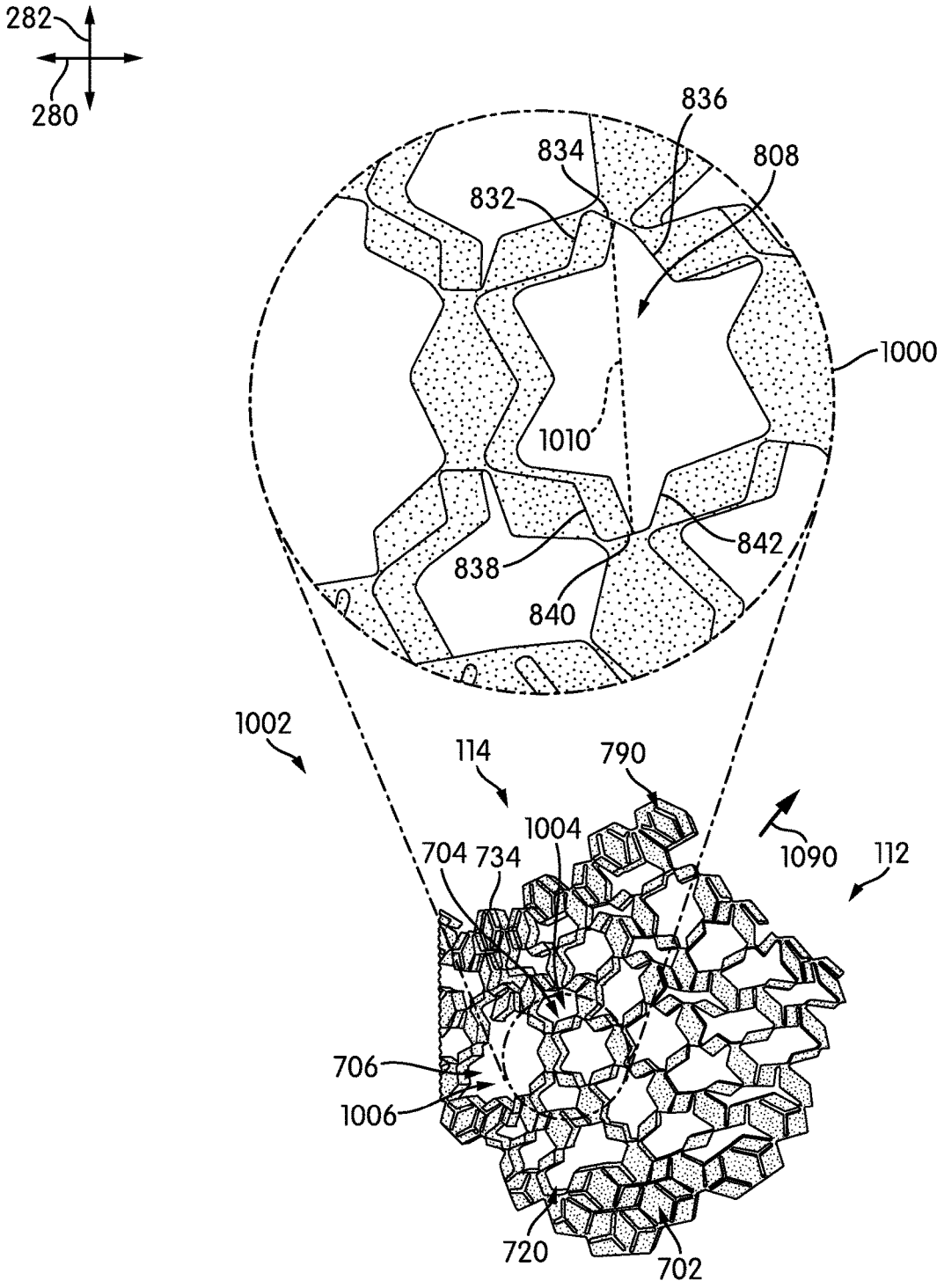
FIG. 10 is a top-down view of an embodiment of a portion of the sole structure in FIG. 7 undergoing a third tension.

In FIGS. 8-10, a sequence of configurations for portions of second sole structure 710 undergoing various forces is illustrated. As noted above, in some embodiments, the geometry and arrangement of members 702 may provide auxetic properties to second sole structure 710 when a force is applied. While the discussion below describes the effect on apertures 720 during auxetic expansion, it should be noted that members 702 may rotate about one or more vertices 830 and their associated connecting portions as a part of this process, such that the rotation of members 702 can allow differences in aperture size, shape, and angle to occur. Thus, the rotation of members 702 may at least in part facilitate the changes in second sole structure 710.

In FIG. 8-10, a third aperture 808 includes a first edge 848, a second edge 846, a third edge 844, a seventh edge 852, an eighth edge 854, a ninth edge 856, a tenth edge 858, and a fourteenth edge 850. Furthermore, third aperture 808 includes a fourth edge 832, a fifth edge 834, a sixth edge 836, an eleventh edge 838, a twelfth edge 840, and a thirteenth edge 842. Each edge is associated with a connecting portion near each vertex that may facilitate rotation of members 702 and expansion of apertures 720, as described with reference to FIGS. 2-6. In FIG. 8, first edge 848, second edge 846, third edge 844, seventh edge 852, eighth edge 854, ninth edge 856, tenth edge 858, and fourteenth edge 850 correspond to the portions of third aperture 808 comprising the two ends or "tails". Fourth edge 832, fifth edge 834, sixth edge 836, eleventh edge 838, twelfth edge 840, and thirteenth edge 842 correspond to the main "body" of third aperture 808, such that fourth edge 832, fifth edge 834, and sixth edge 836 form a first side 860 and eleventh edge 838, twelfth edge 840, and thirteenth edge 842 form a second side 870. First side 860 and second side 870 may be substantially linear in some embodiments. In some embodiments, as a result of increased forces applied to the sole structure, first side 860 and/or second side 870 may become significantly curved near vertices 830 and their associated connecting portions, and form multiple sides along third aperture 808.

As illustrated in FIG. 8, in a second configuration 802, members 702 are shown to be experiencing a first tension 890. In second configuration 802, first tension 890 causes apertures 720 to expand at least in part due to the auxetic structure. This in turn allows the distances between edges to either increase or decrease depending on the geometry of apertures 720 and the orientation of members 702. For example, a fourth separation distance 810 is associated with the distance across third aperture 808 from fifth edge 834 to twelfth edge 840.

Furthermore, angles associated with different portions of third aperture 808 can change as a result of first tension 890, as described with reference to FIGS. 2-6. In FIG. 9, a third configuration 902 is shown, where members 702 are under a second tension 990. Second tension 990 is greater than first tension 890. In third configuration 902, second tension 990 causes apertures 720 to expand further as a result of the auxetic structure. This in turn alters the distances between edges, so that each distance either increases or decreases depending on the geometry of apertures 720 and the orientation of members 702. For example, a fifth separation distance 910 is now associated with the distance across third aperture 808 from fifth edge 834 to twelfth edge 840. Fifth separation distance 910 is greater than fourth separation distance 810 in FIG. 8. The overall (cross-sectional) area of third aperture 808 can be seen to be increasing as the applied tension is increased from FIG. 8 to FIG. 9.

Furthermore, angles associated with different portions of third aperture 808 may also change as a result of second tension 990, as described with reference to FIGS. 2-6. In FIG. 10, a fourth configuration 1002 is shown, where members 702 are under a third tension 1090. Third tension 1090 is greater than second tension 990. In fourth configuration 1002, third tension 1090 causes apertures 720 to expand further as a result of the auxetic structure. This in turn changes the distances between various edges of third aperture 808, so that each distance either increases or decreases depending on the geometry of apertures 720 and the orientation of members 702. For example, a sixth separation distance 1010 is now associated with the distance across third aperture 808 from fifth edge 834 to twelfth edge 840. Sixth separation distance 1010 is greater than fifth separation distance 910 in FIG. 9. The overall area of third aperture 808 can be seen to be increasing as the applied tension is increased from FIG. 9 to FIG. 10.

Furthermore, angles associated with different portions of third aperture 808 may also change as a result of third tension 1090, as described with reference to FIGS. 2-6. In addition, it can be seen that third aperture 808 has transitioned from a ten-sided rounded polygon to a fourteen-sided rounded polygon over the expansion sequence illustrated in FIGS. 7-10. Thus, in some embodiments, as various forces are applied, one or more apertures 720 may change shape dramatically.

For example, in the embodiment of FIG. 8, first side 860 comprising fourth edge 832, fifth edge 834, and sixth edge 836, and second side 870 comprising eleventh edge 838, twelfth edge 840, and thirteenth edge 842 are been illustrated. Both first side 860 and second side 870 comprise a single curving edge. However, during the transition shown in FIGS. 8-10, as an increased tension is applied to third aperture 808, fourth edge 832, fifth edge 834, and sixth edge 836 form a distinctly three-sided portion, as eleventh edge 838, twelfth edge 840, and thirteenth edge 842 also form a distinctly three-sided portion. In other words, first side 860 has come to comprise three distinct sides, and second side 870 has also come to comprise three distinct sides.

The following references include information that may be relevant to the present application: Cross, U.S. Pat. No. 9,402,439, issued on Aug. 2, 2016, titled "Auxetic Structures and Footwear with Soles Having Auxetic Structures", the disclosure of which is hereby incorporated by reference in its entirety, and Cross, U.S. Pat. No. 9,554,624, issued on Jan. 31, 2017, titled "Footwear Soles With Auxetic Material", filed on Mar. 10, 2015, the disclosure of which is hereby incorporated by reference in its entirety.

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A sole structure for an article of footwear comprising:

a group of sole members attached to one another by a group of connecting portions, each of the group of sole members comprising a portion of the sole structure, the group of sole members bounding a group of apertures;

the group of sole members including a first set of sole members, the first set of sole members bounding a first aperture, the first set of sole members being attached to one another by a first set of connecting portions;

the first aperture including a plurality of vertices, each of the first set of connecting portions being associated with a vertex of the first aperture, wherein the first set of connecting portions permit rotation of the first set of sole members;

the first aperture comprising a plurality of edges, the plurality of edges including a first edge, a second edge, a third edge, a fourth edge, a fifth edge, a sixth edge, a seventh edge, an eighth edge, a ninth edge, a tenth edge, an eleventh edge, a twelfth edge, a thirteenth edge, and a fourteenth edge;

wherein each of the plurality of edges is substantially straight;

wherein the fourth edge, the fifth edge, and the sixth edge comprise a substantially linear and continuous first side in a first, relaxed state of the sole structure, and the eleventh edge, the twelfth edge, and the thirteenth edge comprise a substantially linear and continuous second side in the relaxed state, such that the first aperture comprises a ten-sided polygon in the relaxed state;

wherein the fourth edge, the fifth edge, and the sixth edge are nonlinear in a second, tensioned state of the sole structure, and the eleventh edge, the twelfth edge, and the thirteenth edge are nonlinear in the tensioned state, such that the first aperture comprises a fourteen-sided polygon in the tensioned state; and wherein the group of apertures are arranged along the sole structure to provide the sole structure with an auxetic property, wherein the sole structure is formed from an auxetic material such that when the sole structure is tensioned in a first direction, the sole structure expands in the first direction and in a second direction that is substantially perpendicular to the first direction.

2. The sole structure according to claim 1, wherein each sole member of the group of sole members is hingedly connected to at least one adjoining sole member at a connecting portion thereby allowing the sole members to rotate with respect to each other in a plane of the sole structure.

3. The sole structure according to claim 2, wherein the first aperture is a through-hole aperture.

4. The sole structure according to claim 1, wherein the group of apertures further includes a second aperture, and wherein the cross-sectional area of the second aperture is larger than the cross-sectional area of the first aperture.

5. A sole structure for an article of footwear comprising:

wherein the sole structure is formed from an auxetic material;

a ground contacting surface opposite an upper surface and defining a thickness therebetween;

a plurality of apertures extending from the ground contacting surface through a portion of the thickness, wherein the plurality of apertures are arranged across the sole structure to provide the sole structure with an auxetic property, and wherein each of the plurality of apertures includes:

a first end, a second end, and an elongate section between the first end and the second end, wherein the elongate section is defined by opposing sidewalls that are substantially linear and parallel when the sole structure is in a first, relaxed state, and wherein the opposing sidewalls each include three segments arranged in a non-linear manner when the sole structure is in a second, tensioned state;

wherein each aperture is defined by a perimeter consisting of ten contiguous edges when in the first state, and is defined by a perimeter consisting of fourteen contiguous edges when in the second state; the sole structure further including a first sole dimension, a second sole dimension orthogonal to the first sole dimension, and wherein the thickness is orthogonal to both the first sole dimension and the second sole dimension; and wherein the sole structure formed of the auxetic material having the auxetic property is characterized by a negative Poisson's ratio such when the sole structure is tensioned along the first sole dimension, the sole structure expands along the first sole dimension and along the second sole dimension.

6. The sole structure of claim 5, wherein each of the first end and the second for each aperture of the plurality of apertures includes both a first protrusion and a second protrusions extending from an end of the elongate section.

7. The sole structure of claim 5, wherein the plurality of apertures are aligned in rows, and wherein adjacent rows are offset relative to each other.

8. The sole structure of claim 5, wherein each of the plurality of apertures extends through the entire thickness of the sole structure.

9. The sole structure of claim 5, wherein each of the opposing sidewalls elastically deforms when transitioning between the first and second state.

10. The sole structure of claim 5, wherein the tensioned state is characterized by a tensile force on the sole structure.

* * * * *